US011096487B2

(12) United States Patent
Hazarian

(10) Patent No.: US 11,096,487 B2
(45) Date of Patent: Aug. 24, 2021

(54) CONVERTIBLE ARTICLE OF FURNITURE

(71) Applicant: Natasha Hazarian, Austin, TX (US)

(72) Inventor: Natasha Hazarian, Austin, TX (US)

( * ) Notice: Subject to any disclaimer, the term of this patent is extended or adjusted under 35 U.S.C. 154(b) by 0 days.

(21) Appl. No.: 16/721,004

(22) Filed: Dec. 19, 2019

(65) Prior Publication Data

US 2020/0196752 A1 Jun. 25, 2020

Related U.S. Application Data

(60) Provisional application No. 62/783,711, filed on Dec. 21, 2018.

(51) Int. Cl.
*A47B 85/06* (2006.01)
*A47C 16/02* (2006.01)

(52) U.S. Cl.
CPC ..... *A47B 85/06* (2013.01); *A47C 16/025* (2013.01)

(58) Field of Classification Search
CPC ..... A47B 85/04; A47B 85/02; A47B 85/06; A47B 85/00; A47D 11/002; A47D 11/00
USPC ..... 108/13, 11; 297/119, 118
See application file for complete search history.

(56) References Cited

U.S. PATENT DOCUMENTS 144,769 A * 11/1873 Kade ..... A47B 17/04 312/204
553,184 A * 1/1896 Burns ..... A47B 31/06 108/11
715,055 A * 12/1902 Greenlaw et al. ... A47B 13/081 312/228
1,618,922 A * 2/1927 Gardner ..... A47B 67/02 108/11
1,792,993 A * 2/1931 Lochner ..... A47B 85/02 108/8
2,244,036 A * 6/1941 Williman ..... A47B 85/02 108/9
2,564,338 A * 8/1951 McCarroll ..... A47B 85/04 108/62
2,614,611 A * 10/1952 Robertson ..... A47C 3/00 108/13
3,337,879 A * 8/1967 Humphrey ..... A47C 17/62 5/3
3,605,650 A * 9/1971 Hebel et al. ..... A47B 85/02 108/9
3,667,803 A * 6/1972 Ford ..... A47C 16/02 297/119
3,688,707 A * 9/1972 White ..... A47B 13/08 108/159
3,817,573 A 6/1974 Facury
4,031,831 A 6/1977 Davis
4,070,715 A * 1/1978 Reppas ..... A47C 17/62 5/2.1
4,282,817 A * 8/1981 Gutterman ..... A47B 9/00 108/11
5,538,320 A * 7/1996 Hoffman ..... A47C 13/00 297/188.1
5,597,199 A 1/1997 Hoffman et al.
5,727,476 A 3/1998 Priore, Sr.
(Continued)

*Primary Examiner* — Jose V Chen
(74) *Attorney, Agent, or Firm* — Boyle Fredrickson, S.C.

(57) ABSTRACT

An article of furniture can be converted for dual uses as a coffee table and an ottoman, or vice versa, with relative ease using a simple conversion mechanism disposed on the article if furniture and operably connected between a number of convertible members and a base for the article of furniture.

12 Claims, 4 Drawing Sheets

(56) References Cited

U.S. PATENT DOCUMENTS

| | | | | |
|---|---|---|---|---|
| 6,113,182 | A | 9/2000 | Wise | |
| 6,174,026 | B1 | 1/2001 | Wise | |
| 6,296,314 | B1 * | 10/2001 | Klein | A47B 85/04 297/119 |
| 7,341,307 | B2 | 3/2008 | Parker et al. | |
| 10,111,529 | B2 * | 10/2018 | Ray | A47C 19/22 |
| 2005/0229821 | A1 * | 10/2005 | Usselmann | A47B 85/02 108/86 |

* cited by examiner

CONVERTIBLE ARTICLE OF FURNITURE

CROSS-REFERENCE TO RELATED APPLICATIONS

The present application claims priority from U.S. Provisional Patent Application Ser. No. 62/783,711, filed on Dec. 21, 2018, the entirety of which is expressly incorporated herein by reference for all purposes.

FIELD OF THE DISCLOSURE

The present disclosure relates generally to furniture, and more particularly, to coffee tables, ottomans, and a convertible combination thereof.

BACKGROUND OF THE DISCLOSURE

Articles of furniture such as coffee tables and ottomans are known in the prior art. However, each have been presented as a separate piece of furniture in the prior art. Coffee tables generally have a flat upper horizontal surface on which a person may work or place objects, such as magazines, drinks or other items for use by an individual.

Conversely, ottomans typically have a cushioned upper and generally horizontal surface on which person may place or rest some or all of their body on, such as their feet while sitting upon another surface or article of furniture. The cushioned upper surface generally makes ottomans problematic to place items on, as the cushioned surface cannot stably support items thereon. Nevertheless, ottomans may also be used to support objects placed thereon, but usually requires the placement of a separate ancillary solid surface, such as a tray, on the ottoman's cushioned surface to keep objects steady. Some coffee tables and ottomans may also have one or more drawers, shelves or open space below the upper surface wherein one may store objects below the surface top.

Coffee tables and ottomans are generally designed with a fixed construction to be utilized in only one configuration. Such design fails to permit the article of furniture to be used in different ways to accommodate different desired uses for the article of furniture. Thus, one must choose either between a coffee table or an ottoman.

Some designs for a convertible coffee table and ottoman have been proposed. However, these designs lack practicality and ease of use. In particular, the prior convertible designs have an awkward or complicated and/or impractical design and require either unpractical or rather complex mechanisms for changing from one use to the other. See, for example, U.S. Pat. Nos. 3,817,573; 4,031,831; 5,538,320; 5,597,199; 5,727,476; 6,113,182; 6,174,026; 6,296,314; 7,341,307.

In light of the shortcomings of the prior art, a new design is needed that comfortably and efficiently provides a convertible article of furniture that can be utilized as both in dual coffee table and ottoman configurations. The article of furniture should be aesthetically pleasing and constructed for ease of use such that the article is relatively simple to operate and/or convert between configurations for use as either a coffee table and/or an ottoman.

SUMMARY OF THE DISCLOSURE

According to one exemplary aspect of the present disclosure, an article of furniture is provided that may be converted for dual uses as a coffee table and an ottoman, or vice versa, with relative ease using a simple conversion mechanism.

According to another exemplary aspect of the present disclosure, the article of furniture can be made in a variety of shapes and sizes, such as with one or more convertible members or panels.

According to still another aspect of the present disclosure, the article of furniture may also provide storage within the base member in the form of shelves, drawers or a concealed cavity with a base/intermediate member of the article of furniture to store various items.

Additional aspects, features and advantages of the disclosure will be apparent from the following detailed description taken together with the drawing figures.

BRIEF DESCRIPTION OF THE DRAWINGS

Exemplary embodiments of the article of furniture are shown in the accompanying drawings, it should be appreciated that like reference numbers used in the drawings may identify like components.

DETAILED DESCRIPTION OF THE DISCLOSURE

Figure 1:
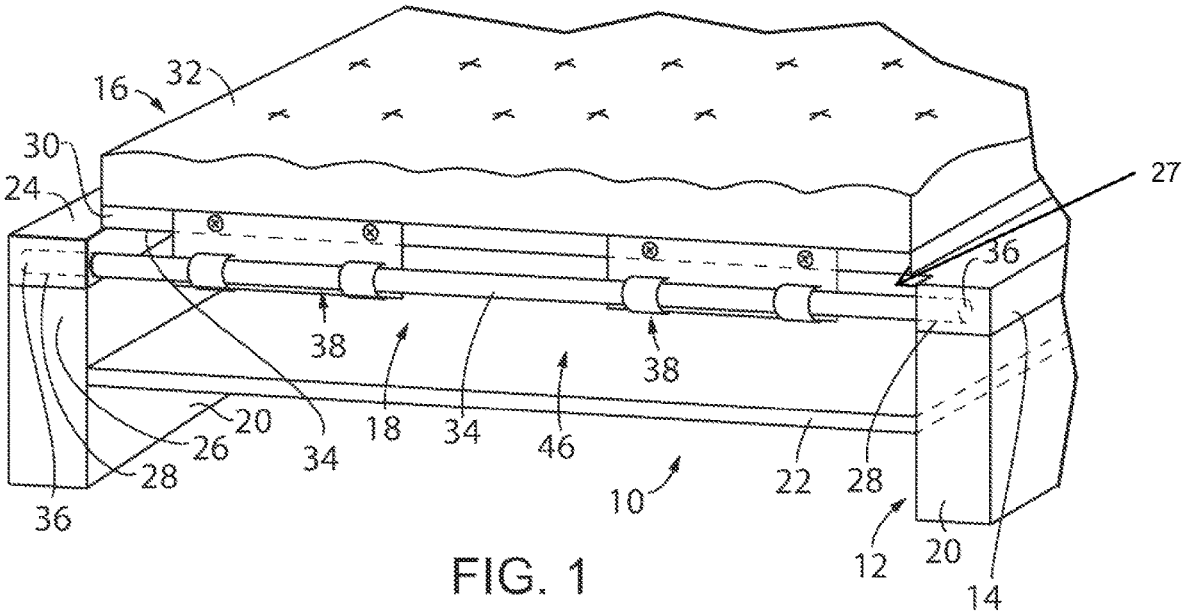
FIG. 1 is a partially broken away perspective view of a first exemplary embodiment of a convertible article of furniture in a first orientation.
Figure 2:
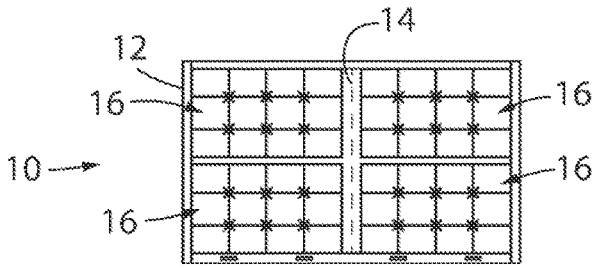
FIG. 2 is a top plan view of the first exemplary embodiment of the convertible article of furniture of FIG. 1.
Figure 3:
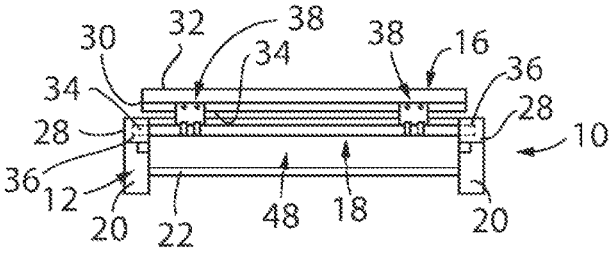
FIG. 3 is a front elevation view of the first exemplary embodiment of the convertible article of furniture of FIG. i.

With reference now to the drawing figures in which like reference numerals designate like parts throughout the disclosure, an exemplary embodiment of an article of furniture constructed according to the present disclosure is illustrated at 10 in FIGS. 1-3. The article of furniture 10 includes a base 12 adapted to be placed on and supported by a surface, such as the floor (not shown), an intermediate member 14 positioned immediately above and extending across the base 12, a number of convertible members 16 positioned above the intermediate member 14, and a converting mechanism 18 engaged between each of the convertible members 16 and the intermediate member 14.

The base 12 can be formed of any suitable material, such as wood, plastic or metal, and operates to support the intermediate member 14 above the floor or other surface on which the base 12 is positioned. The base 12 can have any suitable shape, and in the illustrated exemplary embodiment, the base 12 is formed of a number of and optionally more than two rails 20 that are spaced from one another and extend vertically from the surface to the intermediate member 14. The base 12 can additionally include a lower panel 22 that extends between the rails 20 and is spaced below the intermediate member 14. The lower panel 22 can also be formed of any suitable material, similar to or different from that used to form the base 12/rails 20 and is shaped to conform to the shape of the area defined by the base 12/rails 20.

The intermediate member 14 extends across the base 12/rails 20 opposite the supporting surface and in the illustrated exemplary embodiment is coextensive with the perimeter of the base 12. The intermediate member 14 is formed of a material similar to the base 12 and includes a top surface 24 and a bottom surface 26. The top surface 24 forms a continuous and generally flat surface over the base 12 that can function as a table top in order to enable various items to be positioned and stably supported on the top surface 24 of the intermediate member 14.

In the illustrated exemplary embodiment, the intermediate member 14 includes a recess 27 that extends into the intermediate member 14 from the bottom surface 26 and that includes a pair of guide channels 28 located on opposed sides of the recess 27 between the top surface 24 and bottom surface 26. In the illustrated exemplary embodiment, the guide channels 28 are formed directly within the intermediate member 14 and do not extend completely through the intermediate member 14, such that the guide channels 28 are concealed within the interior of the article of furniture 10. In alternative embodiments, separate structures forming the channels 28 can be secured to the intermediate member 14 on opposed sides of the recess 27.

Each convertible member 16 includes a flat panel 30 having a cushion 32 disposed on one surface of the panel 30 opposite a generally flat surface 33 of the panel 30. The panel 30 is operably connected to the converting mechanism 18 to enable the panel 30 and cushion 32 to be moved or converted with respect to the intermediate member 14 between an ottoman configuration and a coffee table configuration.

As best shown in FIGS. 1 and 4-8, the converting mechanism 18 includes a rotatable bar 34 positioned below the top surface 24 of the intermediate member 14 with the distal ends 36 of the bar 34 each located within one of the guide channels 28. Between the ends 36, the bar 34 extends through one or more hinges 38 attached to the convertible member 16. In the illustrated exemplary embodiment, the hinges 38 are generally L-shaped and include a horizontal portion 40 secured via fasteners 39 to the flat surface 33 of the panel 30 of the convertible member 16 opposite the cushion 32, and a vertical portion 42 secured to an adjacent vertical edge of the panel 30 by fasteners 39.

Figure 4:
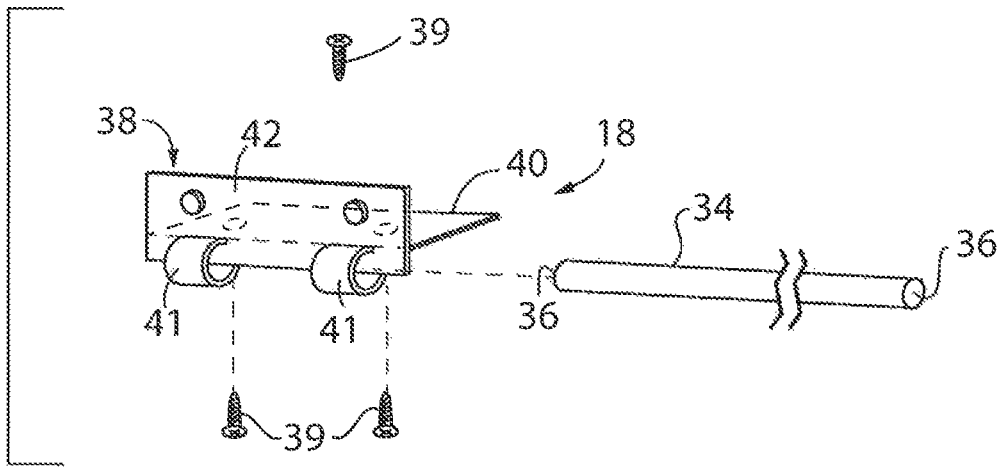
FIG. 4 is an exploded isometric view of a first embodiment of the hinge of the converting mechanism of the convertible article of furniture of FIG. 1.
Figure 5:
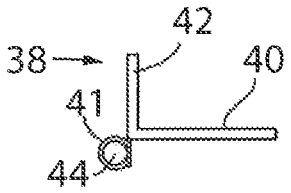
FIG. 5 is a side elevation view of the first embodiment of the hinge of FIG. 4.
Figure 6:
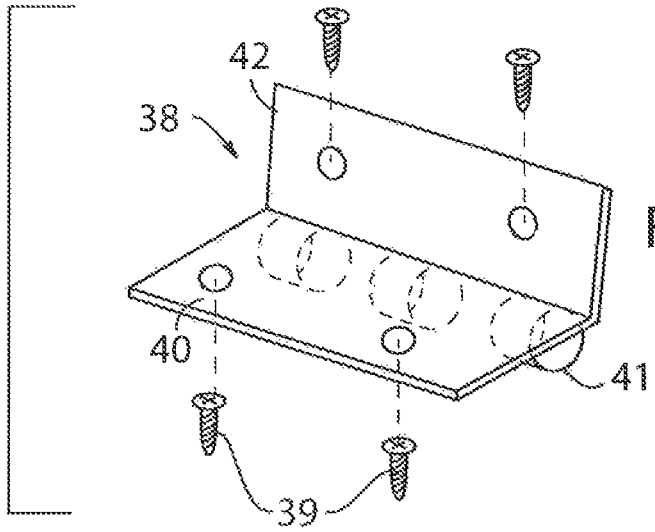
FIG. 6 is an exploded isometric view of a second embodiment of the hinge of the converting mechanism of the convertible article of furniture of FIG. 1.
Figure 7:
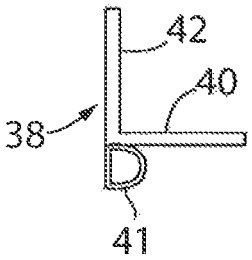
FIG. 7 is a side elevation view of the second embodiment of the hinge of FIG. 6.
Figure 8:
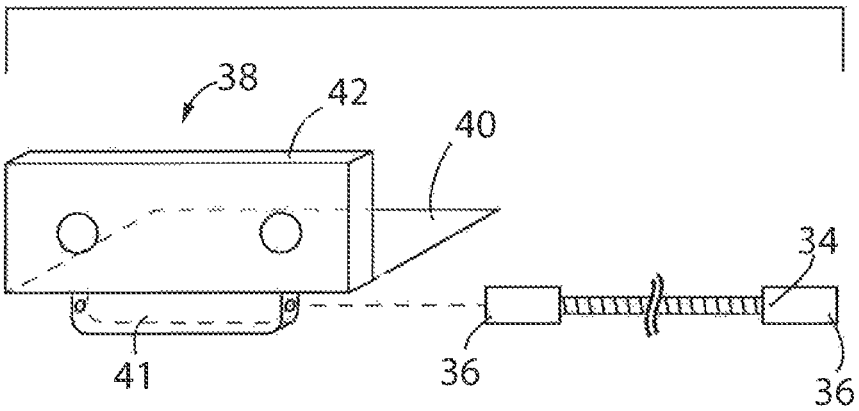
FIG. 8 is an exploded isometric view of a third embodiment of the hinge of the converting mechanism of the convertible article of furniture of FIG. 1.

The hinges 38 also include a number of loops 41 connected at opposite ends to the horizontal portion 40 and optionally to the vertical portion 42, respectively, and that define a passage 44 through which the bar 34 extends. The insertion of the bar 34 through the loops 41 enables the hinge 38 to rotate with respect to the bar 34, such that the convertible member 16 can be flipped from a first position where the cushion 32 (soft surface) forms the upper surface of the convertible member 16, to a second position where the flat surface 33 (hard surface) forms the upper surface. In the embodiment of FIGS. 4 and 5, the loops 41 are separately formed and secured at the intersection of the horizontal portion 40 and vertical portion 42. Alternatively, in the embodiment of FIGS. 6 and 7, the loops 41 are secured to the horizontal portion 40, and in the embodiment of FIG. 8 the loop(s) 41 is formed as a channel extending through an extension of the vertical portion 42.

In operation, initially the convertible member 16 is positioned over the intermediate member 14, with the panel 30 disposed over and/or contacting the top surface 24 of the intermediate member 14. In this position, with the cushion 32 of the convertible member 16 exposed on the article of furniture 10, the article of furniture 10 can function as an ottoman. To convert the article of furniture 10, the convertible member 16 is rotated around the bar 34 using the connection of the hinges 38 to the bar 34 until the panel 30 is disposed above the cushion 32 to expose the flat surface 33. In this position, in addition to being inverted, the entire convertible member 16 is disposed outside of the perimeter of the base 12 due to the rotation of the convertible member 16 around the bar 34. Further, in this inverted position the convertible member 16 is disposed in alignment with the space 46 defined between the intermediate member 14 and the base 12/lower panel 22. With the ability of the bar 34 to slide along the guide channels 28, the bar 34 and the convertible member 16 are then slid inwardly below the top surface 24 of the intermediate member 14 into the space/interior 46 defined between the intermediate member 14 and the lower panel 22. The convertible member 16 can thus be positioned entirely beneath the intermediate member 14, exposing the top surface 24 of the intermediate member 14 to enable the article of furniture 10 to function as a coffee table. This process can similarly be reversed to return the article of furniture 10 to the ottoman configuration. Additionally, the space 46 can be utilized as a storage area, drawer or shelf when the convertible member 16 is not positioned within the space 46.

In alternative embodiments, the space 46 can be formed within the article of furniture 10 to be other than horizontal, such that the base 12 and intermediate member 14 can define a space 46 that is angled, e.g., at a forty-five degree (45°) angle relative to horizontal. The guide channels 28 can be oriented parallel to the space 46 such that less than a full 180° rotation of the convertible member 16 is required to enable the convertible member 16 to slide along the guide members 28 into or out of the space 46.

Further, as the article 10 in the illustrated exemplary embodiment includes four (4) convertible members 16 disposed over the top surface 24, any combination of the convertible member 16 can be moved between the ottoman and coffee table configurations to enable the article to function simultaneously as a coffee table and ottoman with different portions of the article 10 providing the different functions depending upon the configuration of the convertible member 16 for the particular portion.

In alternative exemplary embodiments, the guide channels 28 and/or the ends 36 of the bar 34 may include friction-reducing members (not shown), such as soft material/ball bearings, to facilitate the movement of the bar 34 relative to the channels 28. In another exemplary embodiment, the article of furniture 10 may contain a storage compartment (not shown) within the base 12, such as below the lower panel 22, in the form of one or more shelves and/or drawers or other enclosed compartments for storage of objects or articles.

Figure 9:
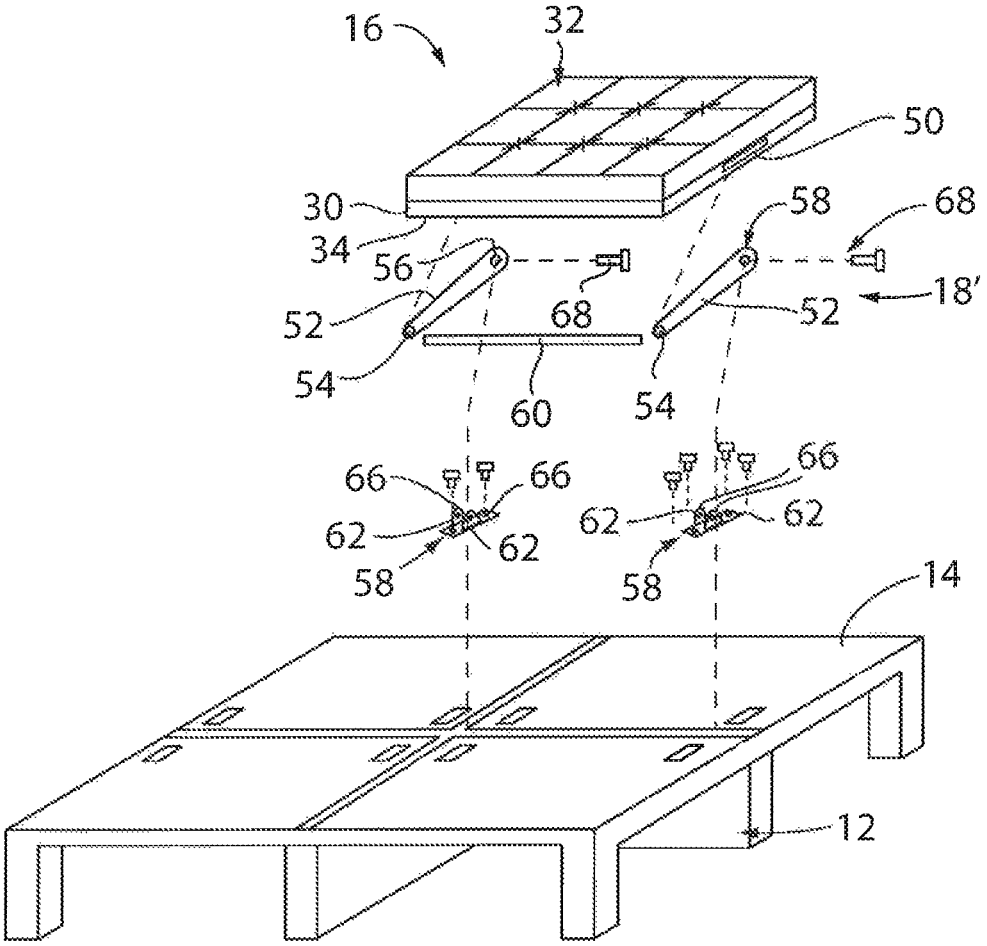
FIG. 9 is an exploded isometric view of a second exemplary embodiment of convertible article of furniture.

In an alternative exemplary embodiment shown in FIG. 9, the article of furniture 10 includes a base 12, an intermediate member 14 positioned immediately above the base 12, one or more convertible members 16 positioned above the intermediate member 14, and a converting mechanism 18 operably connecting the convertible member 16 and the intermediate member 14. In this alternative exemplary embodiment, the convertible member 16 includes a flat panel 30 on one side and cushion 32 on the opposite side, with the panel 30 having a hollowed-out generally elliptical passage 50 extending through a central portion of the panel 30.

In the additional exemplary illustrated embodiment of FIG. 9, the converting mechanism 18 includes a pair of arms 52 disposed on opposite sides of the convertible member 16. The arms include apertures 54,56 at each end, with apertures 54 aligned with the elliptical opening 50 formed in and extending through the panel 30, and apertures 56 aligned with brackets 58 disposed on the intermediate member 14 adjacent one side of the intermediate member 14. The apertures 54 are used to secure the arms 52 to the convertible member 16 by the insertion of a rod 60 through the opening 50 such that each end of the rod 60 projects outwardly from opposite sides of the passage 50. The rod 60 is then secured to the arms 52 using a suitable fastener (not shown), such that the rod 60 can freely rotate and slide within the passage 50 and the arms 52 can freely rotate relative to the rod 60.

Opposite the rod 60, the apertures 56 are disposed between spaced tabs 62 of the bracket 58. The tabs 62 each includes openings 66 therein that are aligned with the apertures 56 in the arms 52 and through which a suitable fastener 68 can be inserted. The fasteners 68 allow the arms 52 to rotate freely with regard to the bracket 68.

In operation, as the brackets 58 are disposed adjacent one side of the intermediate member 14, the convertible member 16 can be disposed flat against the intermediate member 14, with the panel 30 positioned against the intermediate member 14, thus placing the article of furniture 10 in the ottoman configuration.

To convert the article of furniture 10 to the coffee table configuration, the arms 52 are rotated relative to the brackets 58 by lifting the convertible member 16 away from the intermediate member 14, optionally by using a handle (not shown) located on the convertible member 16. The arms 52 are rotated to provide sufficient clearance between the intermediate member 14 and the convertible member 16 that the convertible member 16 can be rotated about the rod 60 between the arms 52 to reverse the positions of the panel 30 and cushion 32 relative to the intermediate member 14. Once the reversal is complete, the convertible member 16 can be lowered onto the intermediate member 14 by rotating the arms 52 relative to the brackets 58 in the opposite direction, thus placing the cushion 32 against the intermediate member 14 and exposing the panel 30, thus providing the coffee table configuration for the article of furniture 10.

The hollowed passage 50 in the panel 30 of the convertible member 16 defines the path of movement along which the convertible member 16 may be pivoted, slid and/or rotated relative to the base 12 and intermediate member 14. The converting mechanism 18 may include a dampening or detent mechanism (not shown) such as a spring or hydraulic device to assist/soften mechanism of converting/rotating the convertible member 16.

Other embodiments of the article of furniture 10 may be configured as different pieces of furniture, as a coffee table or as an ottoman. In some embodiments of the article of furniture 10 may include storage compartments located in the base (under the intermediate member) to store objects, accessible through top and/or side of the base member.

a. First alternative embodiment: flat/horizontal member connects to a bar by means of a hinge fixed to horizontal member; that allows the user to configure from ottoman to coffee table by lifting and rotating member 180 degrees; then sliding member to the underside of base. Bar extends from one end to the other of the member length. Hinge permits the rotation 180 degrees. Member guided into the underside by means of the bar sliding along a track.

b. Alternate preferred embodiment: Same as above except member rotates 180 degrees through connection just on ends of the member.

c. Alternate embodiment: Flat member (table/cushion) rotates along cut out that runs through the center of the flat member; generally u-shaped bar hingeably connected by its distal ends to the base.

In addition to the several objects and advantages of the present invention which have been described, it should be noted that various additional objects and advantages of the present invention may be envisioned by those persons who are skilled in the furniture art from the following more detailed description of the invention, particularly, when such detailed description is taken in conjunction with the attached drawing figures and specifications.

The invention claimed is:

1. A convertible article of furniture comprising:

a. a base;

b. an intermediate member connected to the base; and c. at least one convertible member rotatably connected to the intermediate member by a converting mechanism, the converting mechanism slidably connected to the intermediate member, the convertible member including a flat panel and a cushion disposed on one side of the flat panel, wherein the converting mechanism comprises:

i. a pair of arms connected to the intermediate member; and ii. a rod extending between the arms and connected to the convertible member.

2. The article of furniture of claim 1 wherein the converting mechanism comprises:

a. a hinge operably connected to the convertible member; and b. a rod inserted through the hinge and connected to the intermediate member.

3. The article of furniture of claim 2 wherein the rod is slidably connected to the intermediate member.

4. The article of furniture of claim 2 wherein the rod is slidably and rotatably connected to the intermediate member.

5. The article of furniture of claim 2 wherein the rod is rotatably connected to the hinge.

6. The article of furniture of claim 2 wherein the rod has opposed ends slidably disposed within channels formed in either the base member or the intermediate member.

7. The article of furniture of claim 1 wherein the rod extends between the arms through a channel disposed in the convertible member.

8. The article of furniture of claim 1 wherein the intermediate member defines a space between the intermediate member and the base within which the convertible member can be positioned.

9. The article of furniture of claim 8 further comprising a number of convertible members rotatably and slidably connected to the intermediate member by a converting mechanism, wherein each of the number of convertible members are positionable within the space defined between the intermediate member and the base.

10. A method of converting an article of furniture between a soft surface configuration and a hard surface configuration, the method comprising:

a. providing the convertible article of furniture of claim 1; and b. operating the converting mechanism to move the convertible member between the soft surface configuration and the hard surface configuration.

11. The method of claim 10 wherein the step of operating the converting mechanism comprising concealing the convertible member within a space defined between the intermediate member and the base.

12. The method of claim 10 wherein the step of operating the converting mechanism comprises rotating the convertible member relative to the intermediate member.

* * * * *